US005861739A

United States Patent [19]

Yeo

[11] Patent Number: 5,861,739

[45] Date of Patent: Jan. 19, 1999

[54] TOLERANCE INPUT/OUTPUT CIRCUIT OPERATING IN SINGLE POWER SUPPLY

[75] Inventor: Hyeop-goo Yeo, Yongin-city, Rep. of Korea

[73] Assignee: Samsung Electronics, Co., Ltd., Suwon-City, Rep. of Korea

[21] Appl. No.: 959,261

[22] Filed: Oct. 28, 1997

[30] Foreign Application Priority Data

Oct. 28, 1996 [KR] Rep. of Korea ..... 1996 49322

[51] Int. Cl.[6] ..... G05F 3/08

[52] U.S. Cl. ..... 323/312

[58] Field of Search ..... 323/234, 265, 323/266, 304, 311, 312; 363/13; 325/200, 238, 242, 354

[56] References Cited

U.S. PATENT DOCUMENTS

| | | | |
|---|---|---|---|
| 3,594,762 | 7/1971 | Gardberg et al. | 345/168 |
| 3,594,778 | 7/1971 | Herald et al. | 345/1 |
| 3,740,750 | 6/1973 | Moulton | 342/432 |
| 3,964,702 | 6/1976 | Lardennois et al. | 246/4 |
| 4,178,549 | 12/1979 | Ledenbach et al. | 375/238 |
| 4,298,985 | 11/1981 | Ballard et al. | 375/328 |
| 4,978,905 | 12/1990 | Hoff et al. | 323/314 |
| 5,391,949 | 2/1995 | Vinal | 327/53 |
| 5,559,440 | 9/1996 | Lopresti et al. | 324/607 |

*Primary Examiner*—Adolf Berhane
*Attorney, Agent, or Firm*—Marger, Johnson, McCollom, P.C.

[57] ABSTRACT

A tolerance input/output circuit is provided for operating as the interface of a device to which a predetermined voltage or more cannot be applied to make it operate, depending on whether it is in an input mode or an output mode. The circuit includes an internal power supply, a Y gate signal generator, a kilpoly signal generator, a P gate signal generator and an output circuit. The Y gate signal generator receives an external pad signal of a high level, then generates a signal of an internal power supply level. The kilpoly signal generator generates the signal of the internal power supply level when the pad signal is at a low level, and generates the pad signal when the pad signal is at a high level. In an input mode, the P gate signal generator generates as a P gate signal the signal of the internal power supply level, when the pad signal is at a low level, and the pad signal, when the pad signal is of a high level. In the output mode, the P gate signal generator generates as a P gate signal the internal power supply level when the pad signal is at a low level, and a signal of a low level when the pad signal is at a high level. The output circuit generates a signal which has a high impedance in the input mode and which normally operates to supply the internal power supply level of a high level in the output mode, as the pad signal. The output of the kilpoly signal generator is fed back to the substrates of the PMOS transistors included in the kilpoly signal generator, the P gate signal generator and the output circuit.

18 Claims, 9 Drawing Sheets

TOLERANCE INPUT/OUTPUT CIRCUIT OPERATING IN SINGLE POWER SUPPLY

BACKGROUND OF THE INVENTION

1. Field of the Invention

The present invention relates to a tolerance input/output circuit, and more specifically, to a tolerance input/output circuit operating from a single power supply.

2. Description of the Related Art

FIG. 1 is a circuit diagram of a conventional tolerance input/output circuit. The circuit includes five blocks 10, 20, 30, 40 and 50.

Block 10 generates a correction signal 102, at a level appropriate to the characteristics of a given device, to a Y gate 'Y' and to one of the input terminals of block 20. This correction signal 102 is derived from pad signal 101 which is applied to a PAD and passed through a resistor.

Block 20 receives the correction signal 102 and an enable signal 201, generating an inverted correction signal 102*b* and an inverted enable signal 201*b*.

Block 30 generates a P gate signal 301 depending on whether the circuit is in an input or output mode. Block 30 receives the inverted correction signal 102*b*, the inverted enable signal 201*b* and the pad signal 101.

Block 40 is for generating a kilpoly signal 401. It receives the pad signal 101 and the inverted correction signal 102*b*.

Block 50 receives N gate signal 501 and P gate signal 301, generating a pad signal 502 depending on whether it is in an input or output mode. This pad signal 502 is fed back as the pad signal 101.

FIGS. 2 and 3 show voltage and current characteristics when the pad input voltage is swung from 0V to 5.5V, in the conventional tolerance input/output circuit of FIG. 1. As shown in FIGS. 2 and 3, when the pad voltage is swung to 5.5V, forward-biased diode formed on each source region. The bulk of PMOS transistors included in Block 40 reduces the response speed of the voltage characteristics of the kilpoly signal 401 and generates much leakage current in the substrate.

SUMMARY OF THE INVENTION

The first object of the present invention is to provide a tolerance input/output circuit, acting as the interface of a device having a maximum input voltage limit, dependent on whether it is in an input or output mode. Benefits of the design are twofold, including: the use of only a single power supply (as opposed to the usual two supplies); and the prevention of leakage current in the substrate, even when a voltage of 5 V or higher is applied.

The second object of the present invention is to provide a tolerance input/output circuit to act as the interface of a device having a maximum input voltage limit, depending on whether it is in an input or output mode. Again, a single power supply is used and even when a voltage of 5V or higher is applied, superior driving capability is assured.

To accomplish the above object of the present invention, the tolerance input/output circuit includes an internal power supply, a Y gate signal generator, a kilpoly signal generator, a P gate signal generator and an output circuit.

The internal power supply has a supply voltage appropriate to the device as a specified in the objects of the invention.

The Y gate signal generator outputs a signal of the internal power supply level when the input/output circuit receives a pad signal of a high level.

The kilpoly signal generator outputs a signal of the internal power supply level when the pad signal is at a low level, and of the pad signal level when the pad signal is at a high level.

In an input mode, the P gate signal generator outputs as a P gate signal a signal of the internal power supply level when the pad signal is at a low level, and of the pad signal level when the pad signal is at a high level. In an output mode, the P gate signal generator outputs as a P gate signal a signal of the internal power supply level when the pad signal is at a low level, and of a low level when the pad signal is at a high level.

The output circuit includes a tri-state inverter with inputs of a P gate signal and an internal N gate signal. This circuit outputs, as a pad signal, a signal which has a value of high-impedance in the input mode and which normally operates to supply an internal power supply of a high level in the output mode.

The output of the kilpoly signal generator is applied to bulk regions of PMOS transistors of the kilpoly signal generator, the P gate signal generator and the output circuit.

The output circuit in another embodiment includes two PMOS transistors having tri-state operation according to a P gate signal, and outputs, as a pad signal, a signal which has a value of high-impedance in the input mode and which normally operates to supply an internal power supply of a high level in the output mode.

Consequently, the tolerance input/output circuit can operate from a single power supply.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

Figure 1:
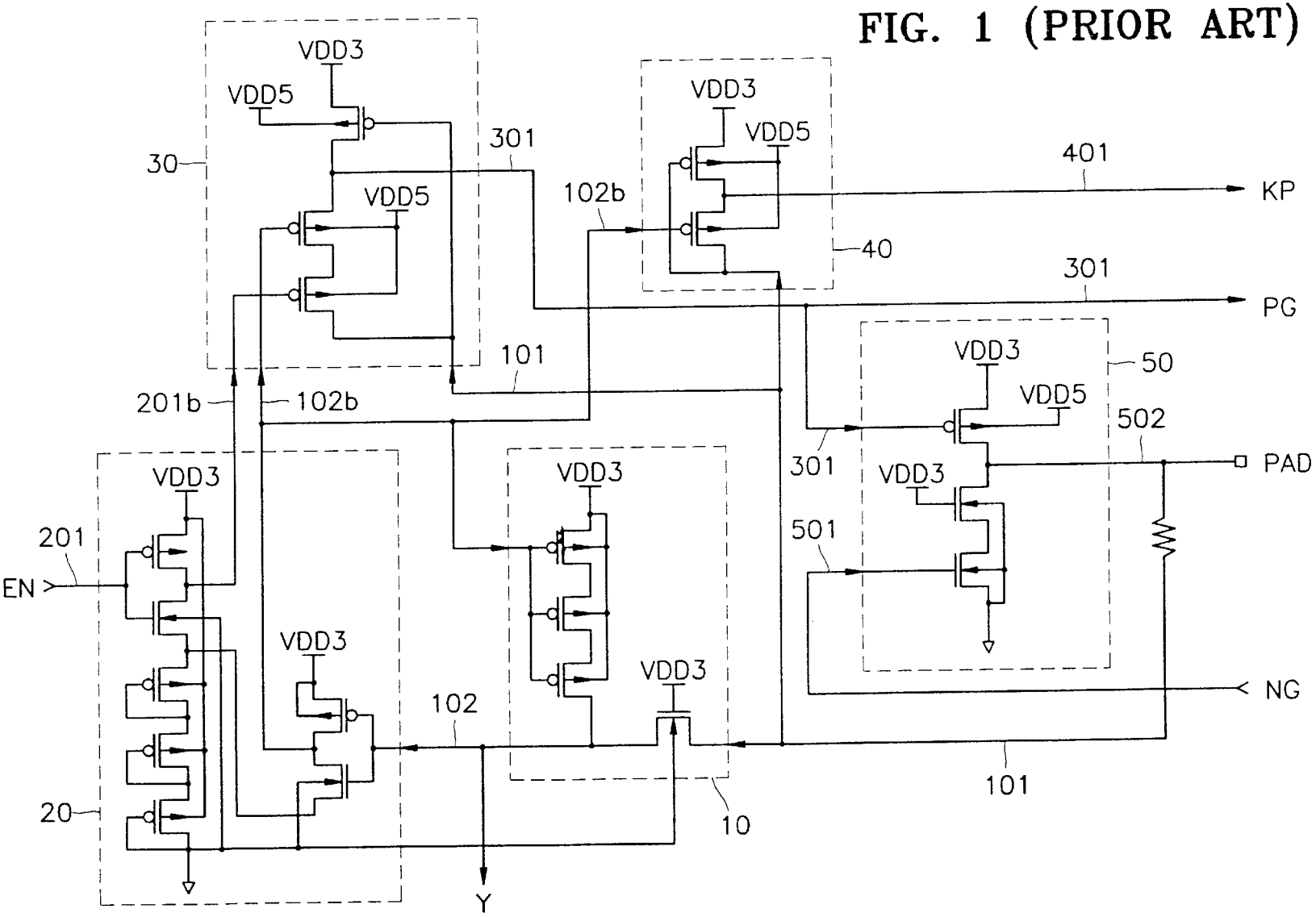
FIG. 1 (PRIOR ART)
FIG. 1 is a circuit diagram of a conventional tolerance input/output circuit.
Figure 2:
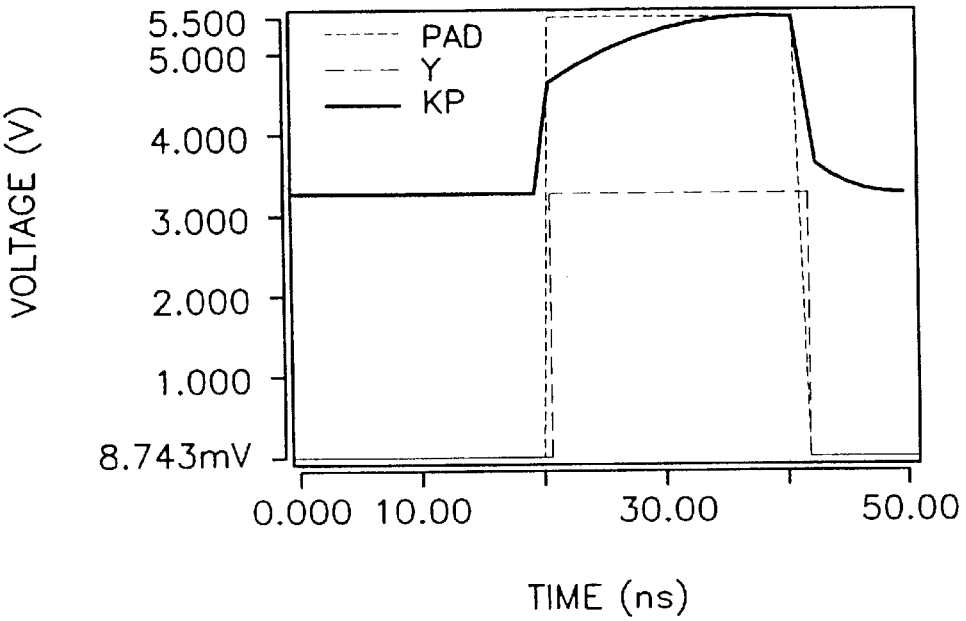
FIG. 2 (PRIOR ART)
FIG. 2 is a graph showing voltage characteristics in an input mode of the conventional tolerance input/output circuit.
Figure 3:
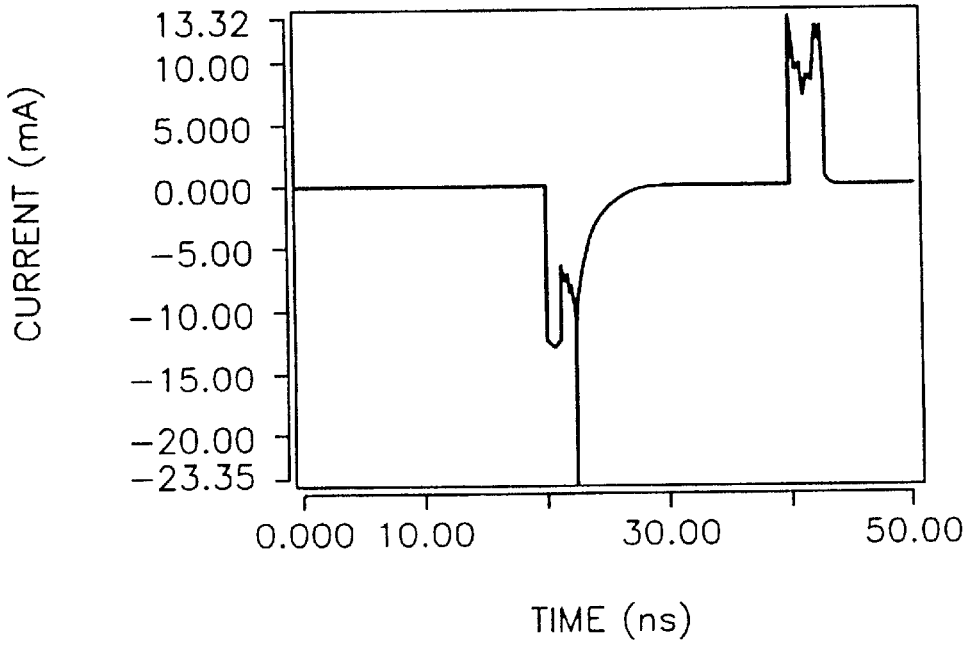
FIG. 3 (PRIOR ART)
FIG. 3 is a graph showing current characteristics in an input mode of the conventional tolerance input/output circuit.
Figure 4:
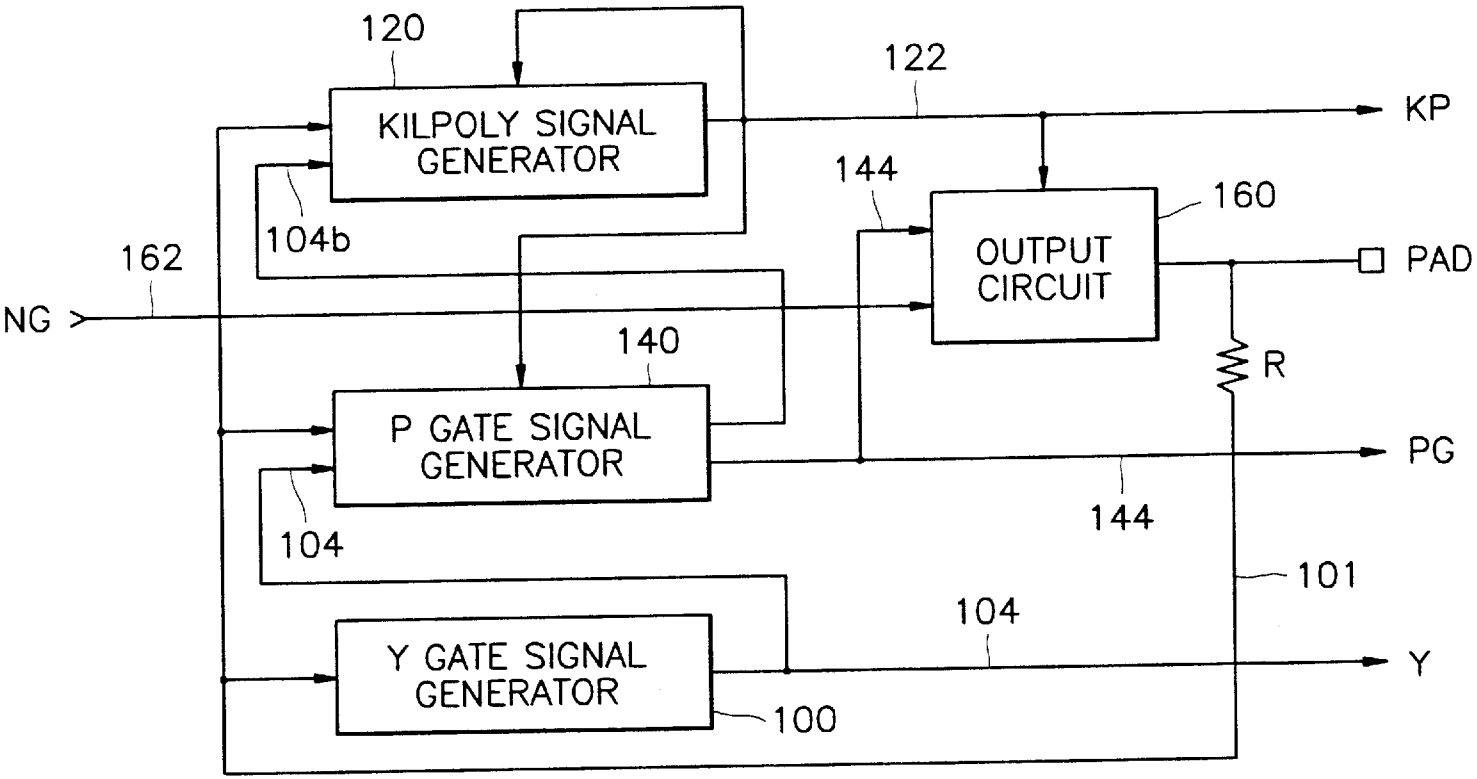
FIG. 4 is a block diagram of a tolerance input/output circuit according to an embodiment of the present invention.
Figure 5:
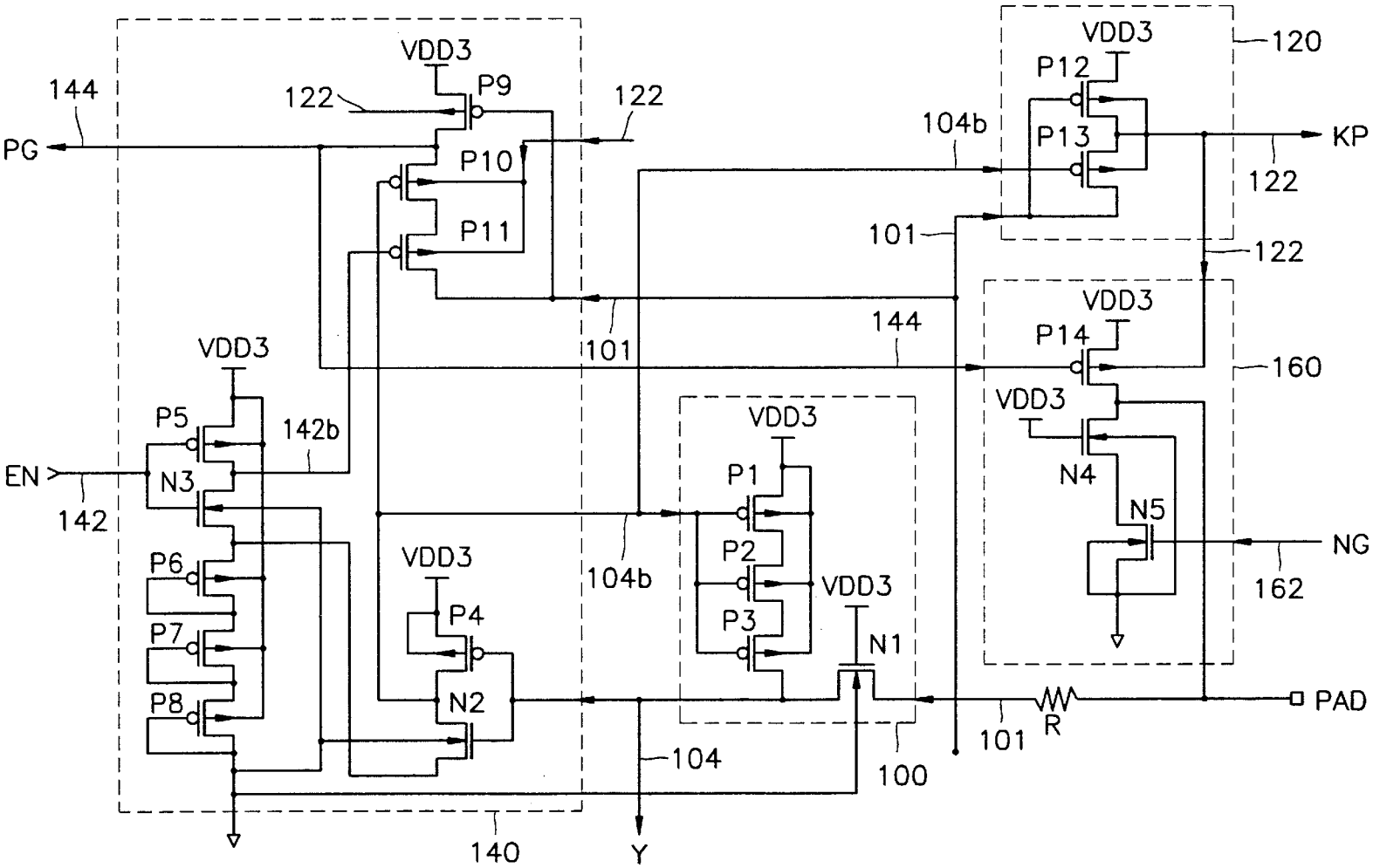
FIG. 5 is a detailed circuit diagram of FIG. 4.

Referring to FIGS. 4 and 5, the tolerance input/output circuit according to an embodiment of the present invention includes a Y gate signal generator 100, a kilpoly signal generator 120, a P gate signal generator 140 and an output circuit 160.

The Y gate signal generator 100 receives a pad signal 101 of a high level 'H' applied to the PAD terminal and passing through a resistor 'R', and generates a signal 104 of an internal power supply (VDD3) level. This signal, 104, has a voltage appropriate for a given device, and outputs to a Y gate terminal 'Y' and one of the input terminals of the P gate signal generator 140.

The transistor level details of the Y gate signal generator 100 are as follows. The block receives the pad signal 101 at the drain of an NMOS transistor N1, and generates a correction signal 104 having a level appropriate to a device. At this time, the correction signal 104 is stabilized by PMOS transistors P1, P2, and P3, each having a gate which receives the inverted correction signal 104*b* from the P gate signal generator 140. P1, P2, and P3 are also serially connected between the internal power supply VDD3 and the source of the NMOS transistor N1. The correction signal 104 is applied to the Y gate terminal 'Y' and one of input terminals of the P gate signal generator 140.

The kilpoly signal generator 120 generates a signal of an internal power supply VDD3 level as a kilpoly signal 122 when the pad signal 101 is at a low level 'L'. When the pad signal 101 is H, it generates pad signal 101 as the kilpoly signal 122.

The transistor level details of the kilpoly signal generator are as follows. The kilpoly signal generator 120 receives the pad signal 101 and the inversion correction signal 104*b*. Regardless of whether the circuit is in input or output mode, when the pad signal 101 is at a low level 'L', a PMOS transistor P12 is turned on and a PMOS transistor P13 is turned off, thereby generating a signal of an internal power supply VDD3 level. When the pad signal 101 is at a high level 'H', the PMOS transistor P13 is turned on and the PMOS transistor P12 is turned off, thereby generating the pad signal 101 as the kilpoly signal 122.

The kilpoly signal 122 is applied to the bulk region of each of PMOS transistors P9 through P14, the P gate signal generator 140 and the output circuit 160, respectively.

In an input mode, the P gate signal generator 140 generates the signal 104*b* of an internal power supply VDD3 level when the pad signal 101 is at a low level 'L'. It generates the pad signal 101 as the P gate signal 144 when the pad signal 101 is at a high level 'H'. Also, in an output mode, the P gate signal generator 140 generates the P gate signal 104*b* at an internal power supply VDD3 level when the pad signal 101 is at a low level 'L', and generates the signal of a low level 'L', when the pad signal 101 is at a high level 'H'.

The P gate signal generator 140 generates the P gate signal 144 dependent on whether the circuit is in input or output mode. It receives an enable signal 142 applied to an enable terminal EN, a correction signal 104, and a pad signal 101. The input/output mode is determined by the enable signal 142. When the enable signal 142 is at a low level 'L', the mode becomes output mode, and when the enable signal 142 is at a high level 'H', the mode becomes input mode. A PMOS transistor P4 and an NMOS transistor N2 receive the correction signal 104 at their respective gates to invert the correction signal 104, generating the inverted correction signal 104*b*. A PMOS transistor P5 and an NMOS transistor N3 receive the enable signal 142 at their respective gates to invert the enable signal 142, and generate the inverted enable signal 142*b*. Here, the gate and source of each of PMOS transistors P6, P7 and P8 are connected together to pull down the inverted correction signal 104*b* and the inverted enable signal 142*b*. In the output mode, when the pad signal 101 is at a low level 'L' the PMOS transistor P9 is turned on and a signal of an internal power supply VDD3 level is generated as the P gate signal 144. When the pad signal 101 is at a high level 'H', the P gate signal 144 is kept to a low level 'L'. In the input mode, when the pad signal 101 is at a low level 'L', a signal of the internal power supply VDD3 level is generated. When the pad signal 101 is at a high level 'H', PMOS transistors P10 and P11 are turned on and the pad signal 101 is generated as the P gate signal 144.

The output circuit 160 includes a tri-state inverter operating according to the P gate signal 144 and an internal N gate signal 162. In an input mode, the output circuit 160 is a tri-state having a high impedance, and in an output mode, the output circuit 160 operates normally to generate a signal having a high level 'H' internal power supply VDD3 as the pad signal 101.

The transistor level details of the output circuit 160 are as follows. The circuit 160 receives an N gate signal 162 from the N gate terminal NG and a P gate signal 144, generating a pad signal to the pad terminal PAD according to the P gate signal 144. The output pad signal is fed back to the pad terminal PAD. In the output pad mode, when the pad signal 101 is at a high level 'H', the PMOS transistor P14 is turned on by the P gate signal 144 of a low level 'L' regardless of the N gate signal 162, and thus the signal of the internal power supply VDD3 level is generated as the pad signal 101. In the input mode, a signal of the internal power supply VDD3 level or the P gate signal 144 of a high level 'H' pad signal is applied to the gate of the PMOS transistor P14 to turn off the PMOS transistor P14 regardless of the state of the pad signal 101. Accordingly, since the N gate signal 162 applied to the N gate terminal NG is set to a low level, the output of the output circuit 160 is high impedance.

As described above, even though the high level signal of 5V or higher is applied to the PAD terminal, the signal is fed back in the form of kilpoly signal 122, to the substrates of the PMOS transistors P9, P10, P11, P12, P13 and P14 of the kilpoly signal generator 120, the P gate signal generator 140 and the output circuit 160. As a result, a forward-biased diode is not formed between source and bulk regions of each of the PMOS transistors P9, P10, P11, P12, P13 and P14, thereby preventing leakage current flowing to the substrates. In addition, a second power supply is not required.

Figure 6:
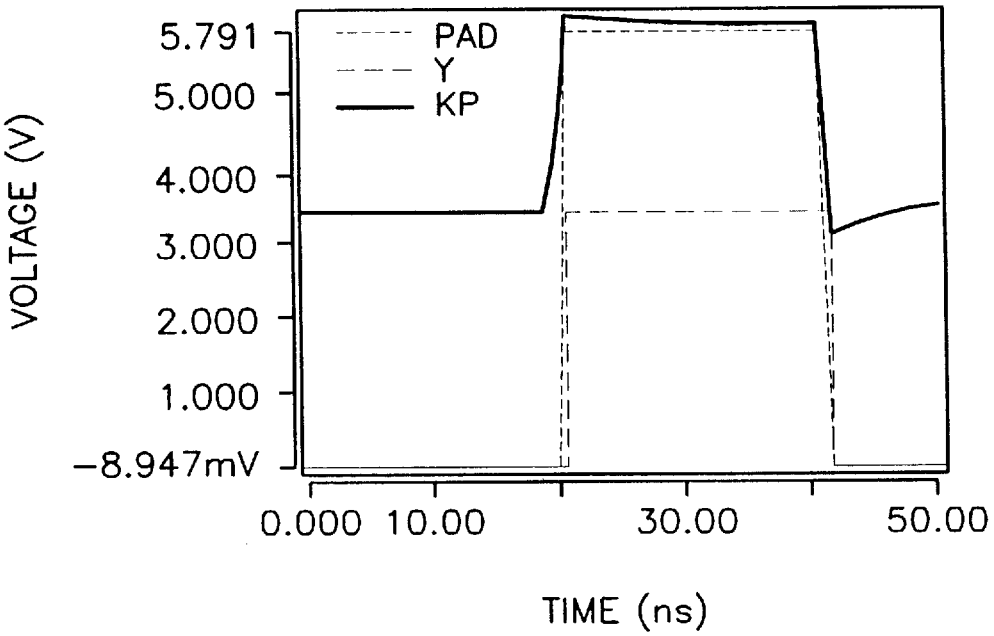
FIG. 6 is a graph showing voltage characteristics in an input mode of a tolerance input/output circuit according to the present invention.
Figure 7:
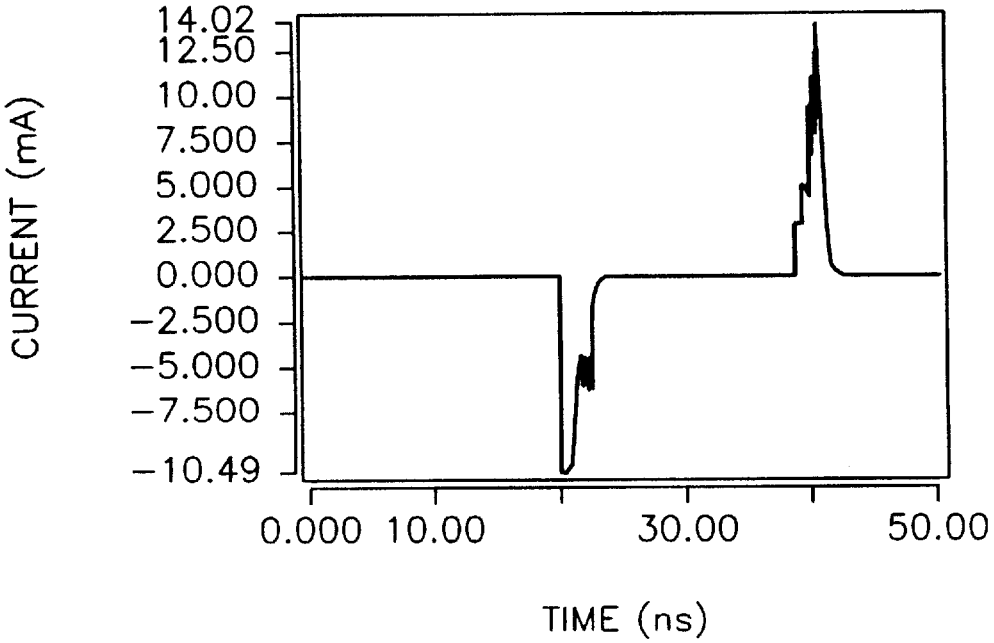
FIG. 7 is a graph showing current characteristics in an input mode of a tolerance input/output circuit according to the present invention.

As shown in FIGS. 6 and 7, when the PAD voltage is swung from 0V to 5.5V, the pad signal 101 is fed back in the form of the kilpoly signal 122 to the bulk of each of PMOS transistors P12 and P13 of the kilpoly signal generator 120, thereby preventing formation of forward diodes between the source regions and the bulk. Also, the rapid response characteristic of the kilpoly signal 122 prevents the leakage current flowing to the bulk.

Figure 8:
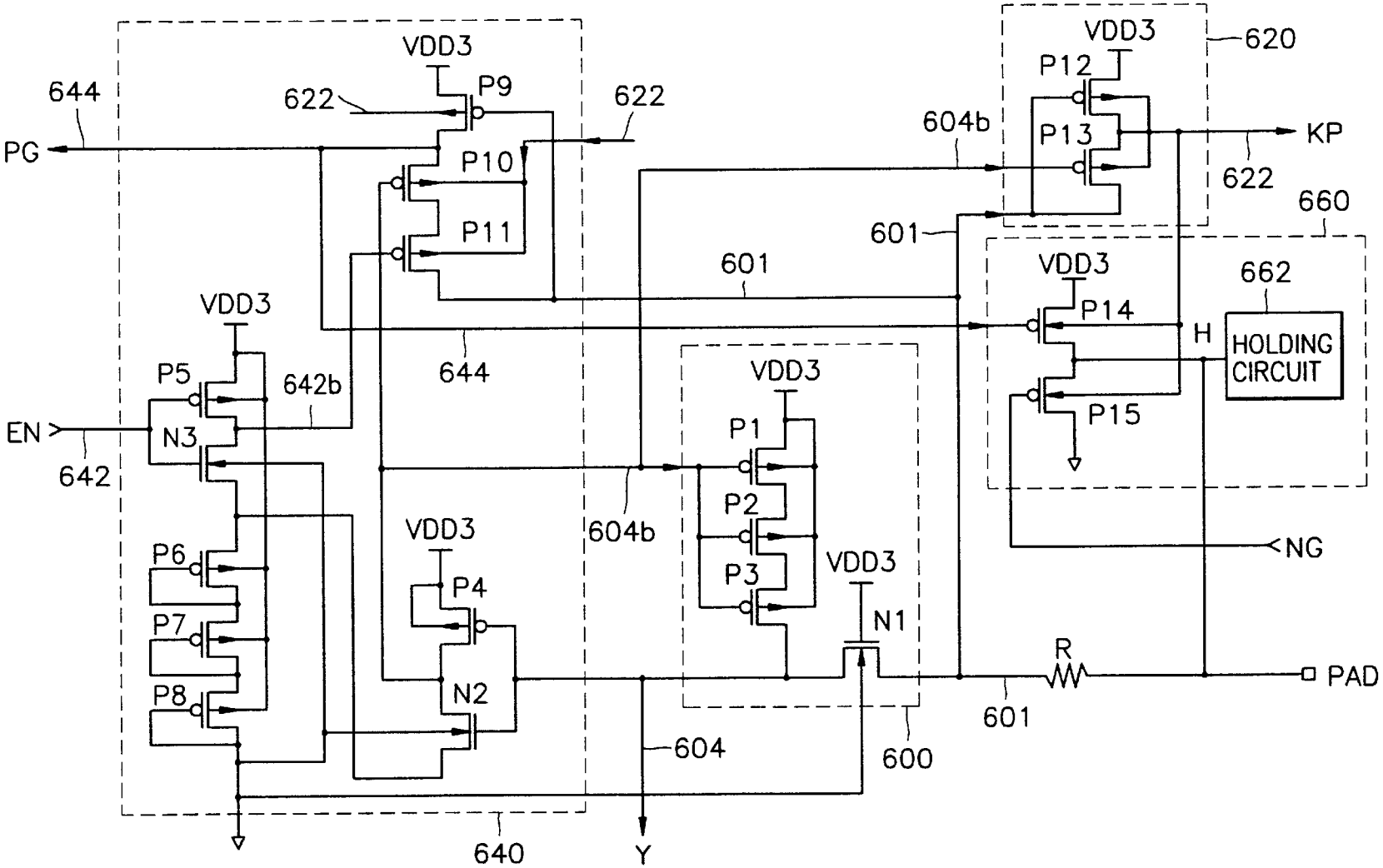
FIG. 8 is a circuit diagram of a tolerance input/output circuit according to another embodiment of the present invention.

FIG. 8 is a circuit diagram of a tolerance input/output circuit according to another embodiment of the present invention.

The tolerance input/output circuit of FIG. 8 includes a Y gate signal generator 600, a kilpoly signal generator 620, a P gate signal generator 640 and an output circuit 660.

In the Y gate signal generator 600, the pad signal 601 of a high level 'H' applied to the PAD terminal and passing through a resistor 'R' is received, and a signal 604 of an internal power supply VDD3 level is generated. Signal 604, having a voltage appropriate to a given device, is transmitted to the Y gate 'Y' and one of input terminals of the P gate generator 640.

The transistor level detail of Y gate signal generator 600 is as follows. The circuit block receives the pad signal 601 at the drain of an NMOS transistor N1 to generate a correction signal 604 with a level appropriate to a given device. At this time, the correction signal 604 is stabilized by PMOS transistors P1, P2 and P3, each having a gate which receives an inverted correction signal 604*b* from the P gate signal generator 640. P1, P2, and P3 are also serially connected between the internal power supply VDD3 and the source of the NMOS transistor N1. The correction signal 604 is applied to the Y gate terminal 'Y' and one of input terminals of the P gate signal generator 640.

The kilpoly signal generator 620 generates the inverted correction signal 604 at an internal power supply VDD3 level as a kilpoly signal 622 when the pad signal 601 is at a low level 'L', and the pad signal 601 as a kilpoly signal 622 when the pad signal 601 is at a high level 'H'.

Regardless of whether in an input or output mode, when the pad signal 601 is at a low level 'L', the PMOS transistor P12 is turned on and the PMOS transistor P13 is turned off, thus the kilpoly signal generator 620 generates a signal of the internal power supply VDD3 level. When the pad signal 601 is at a high level 'H', the PMOS transistor P13 is turned on and the PMOS transistor P12 is turned off, thus the kilpoly signal generator 620 generates the pad signal 601 as the kilpoly signal 622.

The kilpoly signal 622 is fed back to be applied to the bulk region of each of the PMOS transistors P9 through P15 of the kilpoly signal generator 620, the P gate signal generator 640 and the output circuit 660, respectively.

In an input mode, the P gate signal generator 640 generates the signal 104 at the internal power supply VDD3 level as a P gate signal 644 when the pad signal 601 is at a low level 'L', and the pad signal as a P gate signal 644 when the pad signal 601 is at a high level 'H'. Also, in an output mode, the P gate signal generator 640 generates the signal 604 of the internal power supply VDD3 level as the P gate signal 644 when the pad signal 601 is a low level 'L', and a signal of a low level 'L' when the pad signal 601 is at a high level 'H'.

The P gate signal generator 640, generates the P gate signal 144 according to whether the circuit is in the input or output mode. It receives an enable signal 642 applied to an enable terminal EN, a correction signal 604 and a pad signal 601. The input/output mode is determined by the enable signal 642. When the enable signal 642 is at a low level 'L', the mode becomes output mode, and when the enable signal 642 is at a high level 'H', the mode becomes the mode. The PMOS transistor P4 and the NMOS transistor N2 receive the correction signal 604 at their respective gates, and then invert the received correction signal 604 to generate the inverted correction signal 604*b*. The PMOS transistor P5 and the NMOS transistor N3 receive the enable signal 642 at their respective gates, and then invert the received enable signal 642 to generate the inverted enable signal 642*b*. Here, the gate and source of PMOS transistors P6, P7 and P8 are connected together, thereby forming a cutoff constant current source to pull down the inverted correction signal 604*b* and the inverted enable signal 642*b*. In the output mode, when the pad signal 601 is at a low level 'L', the PMOS transistor P9 is turned on, generating a signal of internal power supply VDD3 level as the P gate signal 644. When the pad signal 601 is at a high level 'H', the P gate signal 644 is kept to a low level 'L'. In the input mode, when the pad signal 601 is at a low level 'L', a signal at an internal power supply VDD3 level is generated. When the pad signal 601 is at a high level 'H', the PMOS transistors P10 and P11 are turned on, and the pad signal 601 is generated as the P gate signal 644.

The output circuit 660 includes PMOS transistors P14 and P15, which have a tri-state operation dependent on the P gate signal 644, the N gate signal NG, and a holding circuit 662. In input mode, the circuit's output is high impedance, and in output mode the circuit operates normally to generate a signal at an internal power supply VDD3 level of a high level 'H' as the pad signal 601.

The holding circuit 662 prevents a phenomenon due to the output circuit 660 being driven by PMOS transistors P14 and P15. In output mode, this can cause the voltage of the pad signal 601 to be increased by −Vtp corresponding to the threshold voltage of the PMOS transistors P14 and P15.

Figure 9:
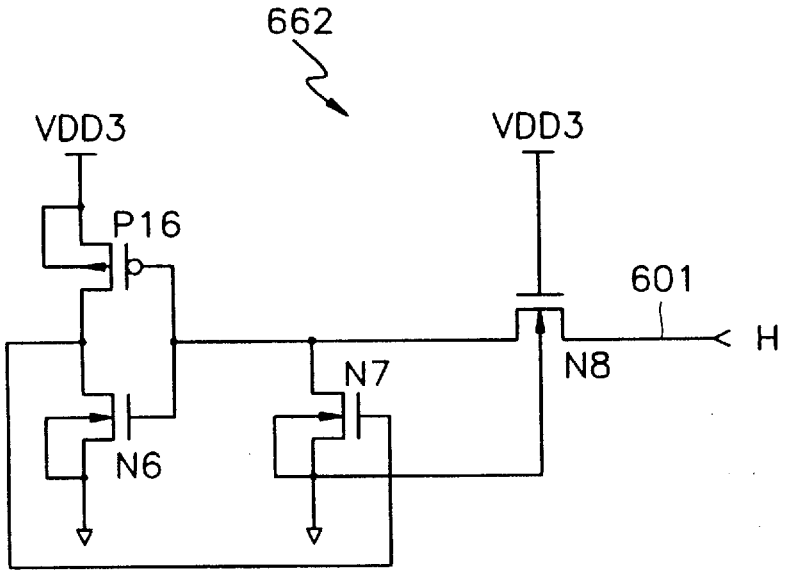
FIG. 9 is a circuit diagram of an embodiment of a holding circuit of FIG. 8.

FIG. 9 is a detailed circuit diagram of an embodiment of the holding circuit 662 of FIG. 8.

Referring to FIG. 9, the holding circuit includes a PMOS transistor P16 and NMOS transistors N6, N7 and N8.

The gate of the NMOS transistor N8 is activated by the internal power supply voltage VDD3, to receive the pad signal 601 through the drain connected to terminal 'H'.

The PMOS transistor P16 and NMOS transistor N6 form an inverter. The PMOS transistor P16 and the NMOS transistor N6 receive the pad signal 601 from the NMOS transistor N8, and invert and transmit the signal.

The NMOS transistor N7 is connected between the gates of PMOS transistor P16, NMOS transistor N6 and ground. Its gate is connected to the output terminals of PMOS transistor P16 and NMOS transistor N6. Consequently, the gate of the NMOS transistor N7 receives a signal inverted by the PMOS transistor P16 and the NMOS transistor N6.

When the pad signal 601 of a high level 'H' passes through the NMOS transistor N8, the pad signal 601 is inverted by the PMOS transistor P16 and the NMOS transistor N6, thereby turning off the NMOS transistor N7. Accordingly, the state of the pad signal 601 is maintained at a high level 'H'. When the pad signal 601 of a low level 'L' passes through the NMOS transistor N8, the pad signal 601 is inverted by the PMOS transistor P16 and the NMOS transistor N6, to thereby turn on the NMOS transistor N7. Consequently, the pad signal 601 is maintained at a low level.

Figure 10:
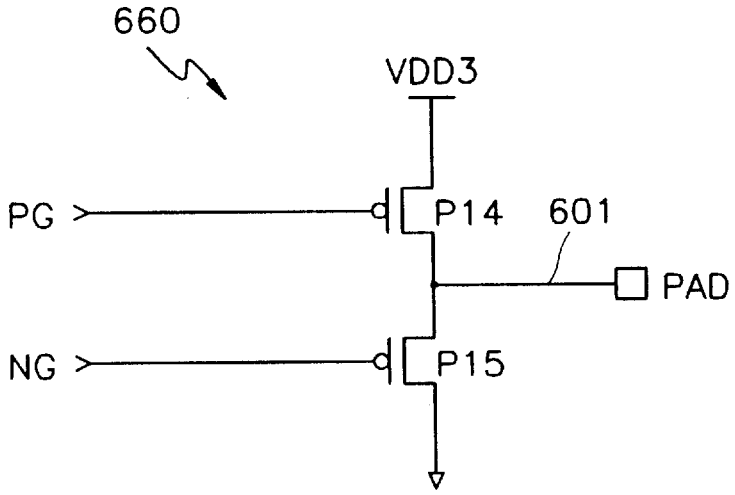
FIG. 10 is a circuit diagram of another embodiment of an output circuit of FIG. 8.

FIG. 10 is a circuit diagram of another embodiment of the output circuit 660 of FIG. 8.

Referring to FIG. 10, the output circuit 660 includes PMOS transistors P14 and P15.

In input mode, the output circuit 660 has a tri-state operation with an output signal 601 of high impedance, and in output mode, operates normally to generate a signal of a high level 'H' (an internal power supply level VDD3) as the pad signal 601. A P gate signal PG and an N gate signal NG are inputs to each gate of the PMOS transistors P15 and P16, respectively.

Figure 11:
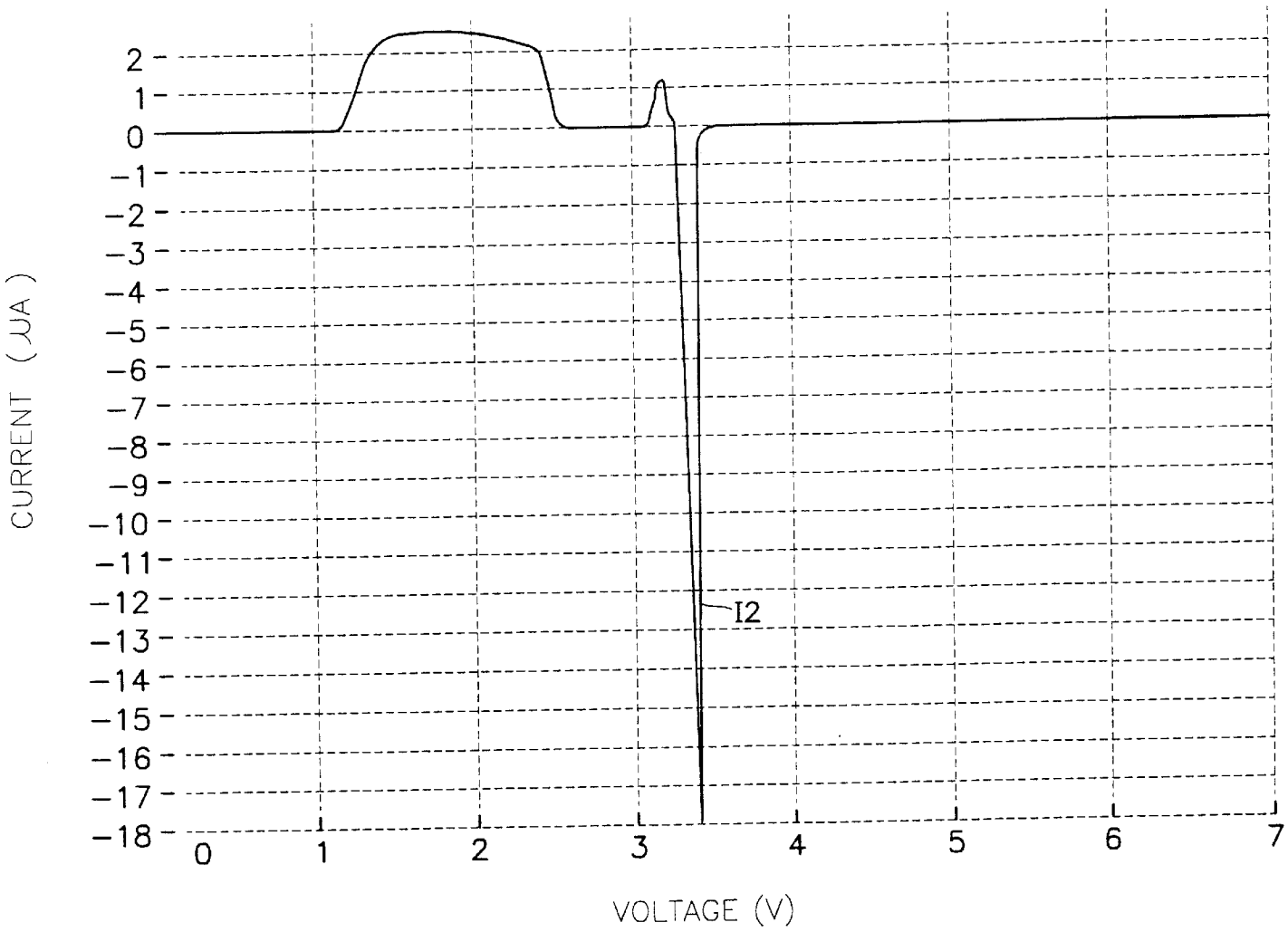
FIG. 11 is a graph showing current characteristics in an input mode of the tolerance input/output circuit of FIG. 8.

FIG. 11 shows current characteristics of the output circuit 660 of FIG. 10, when in the input mode.

As shown in FIG. 11, in a tolerance input/output circuit according to this embodiment of the present invention, the pad signal 601 of a high level 'H' has a very small amount of leakage current 12.

Figure 12:
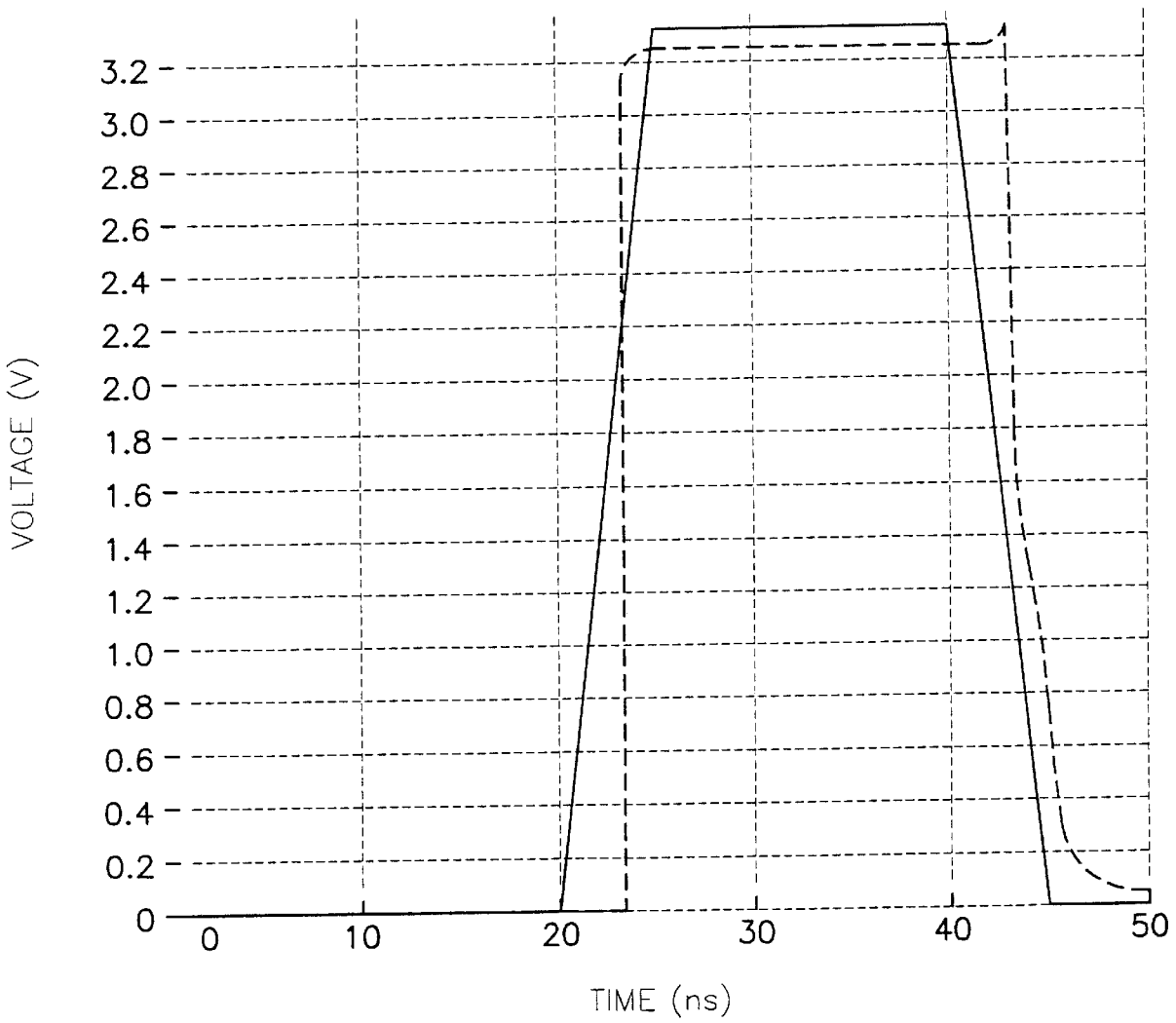
FIG. 12 is a graph showing voltage characteristics in an output mode of the tolerance input/output circuit of FIG. 8.

FIG. 12 shows voltage characteristics of the output circuit 660 of FIG. 10 in output mode. Here, the solid line indicates a signal received by the tolerance input/output circuit of FIG. 10 as the pad signal 601, and the dotted line indicates a signal generated from the output circuit 660 as the pad signal 601 when in an output mode.

As shown in FIG. 12, the output circuit 660 consistently generates the pad signal 601 having a low level 'L'.

As described above, a signal of 5V or higher, applied to the PAD terminal, is fed back to the substrates of PMOS transistors P9 through P15 of the kilpoly signal generator 120, the P gate signal generator 140 and the output circuit 160. This ensures that forward-biased diodes are not formed between the source and bulk regions of each of the PMOS transistors P9 through P15, thereby preventing leakage current flowing to the substrates. Again, an additional power supply is not required.

Since the output circuit 660 is driven by only the PMOS transistors P14 and P15, the driving capability of the output circuit 660 is increased by approximately twice that of a conventional tolerance input/output circuit.

In a tolerance input/output circuit, the present invention is for acting as the interface of a device to which a predetermined voltage or greater cannot be applied. A signal applied to the PAD terminal is fed back, thereby preventing leakage current from flowing in the substrates without requiring an additional power supply. Also, the tolerance input/output circuit has an output circuit which drives using only PMOS transistors, to thereby enhance driving capability.

It should be understood that the invention is not limited to the illustrated embodiment, and that many changes and modifications can be made within the scope of the invention by a person skilled in the art.

I claim:

1. A tolerance input/output circuit for acting as the interface of a device to which a predetermined voltage or more cannot be applied to make it operate, comprising:

an internal power supply;

a Y gate signal generator for receiving an external pad signal applied to the input/output circuit, to generate a signal having the internal power supply level when the pad signal is at a high level;

a kilpoly signal generator for generating a signal of the internal power supply level when the pad signal is at a low level, and generating the pad signal as a control signal when the pad signal is at a high level, regardless of being in an input mode or an output mode;

a P gate signal generator for generating a signal of the internal power supply level when the pad signal is at a low level, and generating the pad signal as the P gate signal when the pad signal is at a high level, in the input mode, and for generating a signal of the internal power supply level when the pad signal is at a low level, and generating a signal of the low level as the P gate signal when the pad signal is at a high level, in the output mode; and an output circuit, having an output which has a high impedance when in the input mode, and which normally operates when in the output mode to supply the internal power supply level of a high level, according to the P gate signal and the external N gate signal, as the pad signal;

wherein the control signal is fed back to the bulks of PMOS transistors included in the P gate signal generator, the kilpoly signal generator and the output circuit.

2. The tolerance input/output circuit of claim 1, wherein the tolerance input/output circuit operates as an input buffer circuit and is for interfacing a signal, received from a peripheral system of the device, with the device, in the input mode.

3. The tolerance input/output circuit of claim 1, wherein the tolerance input/output circuit operates as an output buffer circuit and is for interfacing a signal, received from the device, with a peripheral system of the device, in the output mode.

4. The tolerance input/output circuit of claim 1, wherein the tolerance input/output circuit operates as both input and output buffer circuits, and is for bi-directionally interfacing signals, between the device and the peripheral system of the device, with each other, according to being in an input or output mode.

5. The tolerance input/output circuit of claim 1, wherein the Y gate signal generator comprises:

a first NMOS transistor having a drain receiving the pad signal, a gate connected to the internal power supply, and a source which outputs the pad signal; and first through third PMOS transistors serially connected between the internal power supply and the source of the first NMOS transistor.

6. The tolerance input/output circuit of claim 1, wherein the P gate signal generator comprises:

a first inverter for inverting the output of the Y gate signal generator;

a second inverter for inverting an enable signal;

a fourth PMOS transistor having a source connected to the internal power supply and a gate receiving the pad signal;

a fifth PMOS transistor having a source connected to the drain of the fourth PMOS transistor and a gate receiving the output of the first inverter; and a sixth PMOS transistor having a source connected to the drain of the fifth PMOS transistor, a drain receiving the applied pad signal, and a gate receiving the output of the second inverter, whereby the control signal is applied to the bulk regions of the fourth through sixth PMOS transistors.

7. The tolerance input/output circuit of claim 1, wherein the kilpoly signal generator comprises:

a seventh PMOS transistor having a source connected to the internal power supply and a gate receiving the pad signal; and an eighth PMOS transistor having a source connected to the drain of the seventh PMOS transistor, a drain receiving the pad signal, and a gate receiving the output of the first inverter, whereby the control signal is applied to the bulk regions of the seventh and eighth PMOS transistors.

8. The tolerance input/output circuit of claim 1, wherein the output circuit comprises:

a ninth PMOS transistor having a source connected to the internal power supply and a gate receiving the P gate signal;

a second NMOS transistor having a drain connected to the drain of the ninth PMOS transistor, a gate connected to the internal power supply and a drain generating the pad signal; and a third NMOS transistor connected between the source of the second NMOS transistor and the ground, and having a gate for receiving the N gate signal, whereby the control signal is applied to the a bulk region of the ninth PMOS transistor.

9. A tolerance input/output circuit for operating as the interface of a device to which a predetermined voltage or more cannot be applied to make it operate, comprises:

an internal power supply;

a Y gate signal generator for receiving an external pad signal applied to the input/output circuit, to generate a signal having the internal power supply level when the pad signal is at a high level;

a kilpoly signal generator for generating a signal of the internal power supply level when the pad signal is at a low level, and generating the pad signal as a control signal when the pad signal is at a high level, regardless of being in an input mode or an output mode;

a P gate signal generator for generating a signal of the internal power supply level when the pad signal is at a low level, and generating the pad signal as the P gate signal when the pad signal is at a high level, in the input mode, and for generating a signal of the internal power supply level when the pad signal is a low level, and generating a signal of the low level as the P gate signal when the pad signal is at a high level, in the output mode; and an output circuit having an output which has a high impedance when in the input mode, and which normally operates when in the output mode, to supply an internal power supply voltage of a high level as the pad signal, wherein the control signal is fed back to the bulks of PMOS transistors included in the P gate signal generator, the kilpoly signal generator and the output circuit, and is driven only by PMOS transistors of the output circuit.

10. The tolerance input/output circuit of claim 9, wherein the tolerance input/output circuit operates as an input buffer circuit and is for interfacing a signal, received from a peripheral system of the device, with the device, in the input mode.

11. The tolerance input/output circuit of claim 9, wherein the tolerance input/output circuit operates as an output buffer circuit and is for interfacing a signal, received from the device, with the peripheral system of the device, in the output mode.

12. The tolerance input/output circuit of claim 9, wherein the tolerance input/output circuit operates as both input and output buffer circuits, and is for bi-directionally interfacing signals between the device and the peripheral system of the device with each other.

13. The tolerance input/output circuit of claim 9, wherein the Y gate signal generator comprises:

a first NMOS transistor having a drain receiving the pad signal, and a source which outputs the pad signal, and a gate connected to the internal power supply; and first through third PMOS transistors serially connected between the internal power supply and the source of the first NMOS transistor.

14. The tolerance input/output circuit of claim 9, wherein the P gate signal generator comprises:

a first inverter for inverting the output of the Y gate signal generator;

a second inverter for inverting an enable signal;

a fourth PMOS transistor having a source connected to the internal power supply and a gate receiving the pad signal;

a fifth PMOS transistor having a source connected to the drain of the fourth PMOS transistor and a gate receiving the output of the first inverter; and a sixth PMOS transistor having a source connected to a drain of the fifth PMOS transistor, a drain connected to the pad signal and a gate receiving the output of the second inverter, whereby the control signal is applied to the bulk regions of the fourth through sixth PMOS transistors.

15. The tolerance input/output circuit of claim 9, wherein the kilpoly signal generator comprises:

a seventh PMOS transistor having a source connected to the internal power supply and a gate receiving the pad signal; and an eighth PMOS transistor having a source connected to the drain of the seventh PMOS transistor, a drain receiving the pad signal, and a gate receiving the output of the first inverter, whereby the control signal is applied to the bulk regions of the seventh and eighth PMOS transistors.

16. The tolerance input/output circuit of claim 9, wherein the output circuit comprises:

a ninth PMOS transistor having a source connected to the internal power supply and a gate receiving the P gate signal:

a tenth PMOS transistor connected between the pad signal and the ground, and a gate receiving the pad signal; and a holding circuit for receiving the pad signal and holding the pad signal at the ground level, whereby the control signal is applied to the bulks of the ninth and the tenth PMOS transistors.

17. The tolerance input/output circuit of claim 9, wherein the holding circuit comprises:

a fourth NMOS transistor having a drain receiving the pad signal, and a source generating the pad signal, and a gate connected to the internal power supply;

a third inverter for inverting the output of the fourth NMOS transistor; and a fifth NMOS transistor connected between the source of the fourth NMOS transistor and the ground, having a gate connected to the signal generated from the third inverter.

18. The tolerance input/output circuit of claim 9, wherein the output circuit comprises:

a ninth PMOS transistor connected between the internal power supply and the pad signal, having a gate for receiving the P gate signal; and a tenth PMOS transistor connected between the pad signal and the ground, having a gate for receiving an N gate signal, whereby the control signal is applied to the bulk regions of the ninth and tenth PMOS transistors.

* * * * *